US007156677B2

(12) United States Patent
Yamane

(10) Patent No.: US 7,156,677 B2
(45) Date of Patent: Jan. 2, 2007

(54) ELECTRICAL CONNECTION BOX WITH DRAINAGE CHANNEL

(75) Inventor: Shigeki Yamane, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/195,802

(22) Filed: Aug. 3, 2005

(65) Prior Publication Data

US 2006/0030175 A1 Feb. 9, 2006

(30) Foreign Application Priority Data

Aug. 4, 2004 (JP) ..... P2004-228202

(51) Int. Cl.
*H01R 12/00* (2006.01)

(52) U.S. Cl. ..... 439/206; 439/949

(58) Field of Classification Search ..... 439/76.2, 439/949, 206

See application file for complete search history.

(56) References Cited

U.S. PATENT DOCUMENTS 4,871,884 A * 10/1989 Hayashi ..... 174/560
4,909,745 A * 3/1990 Hayashi ..... 439/76.2
4,952,753 A * 8/1990 Hayashi et al. ..... 174/559
4,954,085 A * 9/1990 Inoue et al. ..... 439/34
4,963,099 A * 10/1990 Sato et al. ..... 439/76.2
5,516,301 A * 5/1996 Kawakita ..... 439/206
5,959,249 A * 9/1999 Hotta ..... 174/60
6,494,723 B1 * 12/2002 Yamane et al. ..... 439/76.2
6,796,809 B1 9/2004 Kakuta et al.
2002/0053476 A1 * 5/2002 Yuasa et al. ..... 180/65.8

FOREIGN PATENT DOCUMENTS

JP 2002-150971 5/2002
JP A 2003-348732 12/2003

* cited by examiner

*Primary Examiner*—Neil Abrams
(74) *Attorney, Agent, or Firm*—Oliff & Berridge, PLC

(57) ABSTRACT

An electrical connection box includes a fuse box having a bottom wall, the fuse box detachably and attachably accommodating a fuse element; a circuit casing being disposed below the fuse box, the circuit casing having a supporting section on an upper surface therof; the circuit casing accommodating a circuit assembly unit; and a plurality of bus bars electrically connecting between the fuse box and the circuit assembly unit, each bus bar being pulled out from the bottom face and drawn into the circuit casing through a wiring path of bus bar along a lower surface of the bottom wall. A draining space is formed between the fuse box and the circuit casing. The supporting section supports the bus bars from a lower side of the bus bars to at least partially come into contact with the bus bar along the bottom wall.

2 Claims, 6 Drawing Sheets

ELECTRICAL CONNECTION BOX WITH DRAINAGE CHANNEL

BACKGROUND OF THE INVENTION

1. Field of the Invention

The present invention relates to an electrical connection box.

2. Description of the Related Art

In JP-A-2003-348732, electrical connection boxes, which are mounted on automobiles, are occasionally disposed in an engine room or the like. Therefore, there have been taken some measures to prevent the circuit board and/or bus bars from short-circuiting due to water, which invades the engine room during washing an automobile.

In the electrical connection box, on the upper face of a frame 3 for accommodating the circuit board, a mounting section 3*c* for connecting an external connector is integrally formed. In the mounting section 3*c*, a terminal receiving hole 3*d* is formed vertically therethrough. And in the terminal receiving hole 3*d*, a contact terminal (bus bars) 13 for connecting the terminals of an external connector to the circuit board is accommodated. Therefore, there is a possibility that water may invade into the electrical connection box via the terminal receiving hole 3*d* and immerse the circuit board therein through the bus bars.

To protect the circuit board 5, an independent part 11 is attached water-tightly to the periphery of the bus bars 13 in the path from the mounting section 3*c* to the circuit board 5; thereby, the flow path of the water flowing along the bus bars 13 is changed.

SUMMARY OF THE INVENTION

For example, as shown in FIGS. 6A and 6B, in a connection box main body 17, which is formed separately from a fuse box 15, is disposed below the fuse box 15, in some cases, bus bars 18, which electrically connect between the fuse box 15 and circuit board accommodated in the connection box main body 17, are pulled out from the bottom wall of the fuse box 15 and laid up to a connection box main body 17 via a wiring path along the lower surface 15A of the bottom wall.

In this case, water falls into the fuse box 15 flow from the fuse box 15 to the connection box main body 17 via the bus bars 18. When such water drops are accumulated on the upper face of the connection box main body 17, the bus bars adjacent to each other in that area may be short-circuited. As a preventive measure against such short-circuits, it is conceivable to form a space between a portion 18A of the bus bars 18, which is pulled out through the bottom wall, and the connection box main body 17. However, when such space 19 is formed, satisfactory support of the bus bars 18 is hardly obtained. As a result, when mounting/replacing fuses, as shown in FIG. 6B, the portion 18A of the bus bars 18, which is pulled out through the bottom wall, may be deformed.

It is an object of the present invention to provide an electrical connection box capable of reliably supporting the bus bars as well as preventing short-circuits.

According to one aspect of the invention, there is provided an electrical connection box, including: a fuse box having a bottom wall, the fuse box detachably and attachably accommodating a fuse element; a circuit casing being disposed below the fuse box, the circuit casing having a supporting section on an upper surface thereof; the circuit casing accommodating a circuit assembly unit; and a plurality of bus bars electrically connecting between the fuse box and the circuit assembly unit, each bus bar being pulled out from the bottom face of the fuse box and drawn into the circuit casing through a wiring path of each bus bar along a lower surface of the bottom wall of the fuse box. A draining space is formed between the fuse box and the circuit casing. The supporting section of the circuit casing supports the bus bars from a lower side of the bus bars to at least partially come into contact with the bus bar along the bottom wall of the fuse box.

Since a draining space is formed between the bus bars and the circuit casing, water drops are prevented from being accumulated on the upper surface of the circuit casing.

Accordingly, on the upper surface of the circuit casing, the adjacent bus bars are prevented from short-circuiting therebetween (short-circuit prevention).

Since the supporting section is formed on the upper surface of the circuit casing, the bus bars can be reliably supported.

According to another aspect of the invention, the supporting section of the circuit casing comprises a plurality of support plates along a direction of the bus bars aligned with each other. Each support plate is opposing each bus bar to support the bus bars independently.

According to the above-aspects of the invention, since each of the support plates supports each of the bus bars independently, the reliability in support of the bus bars is increased.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

An embodiment of the present invention will be described with reference to FIG. 1 to FIG. 5.

Figure 1:
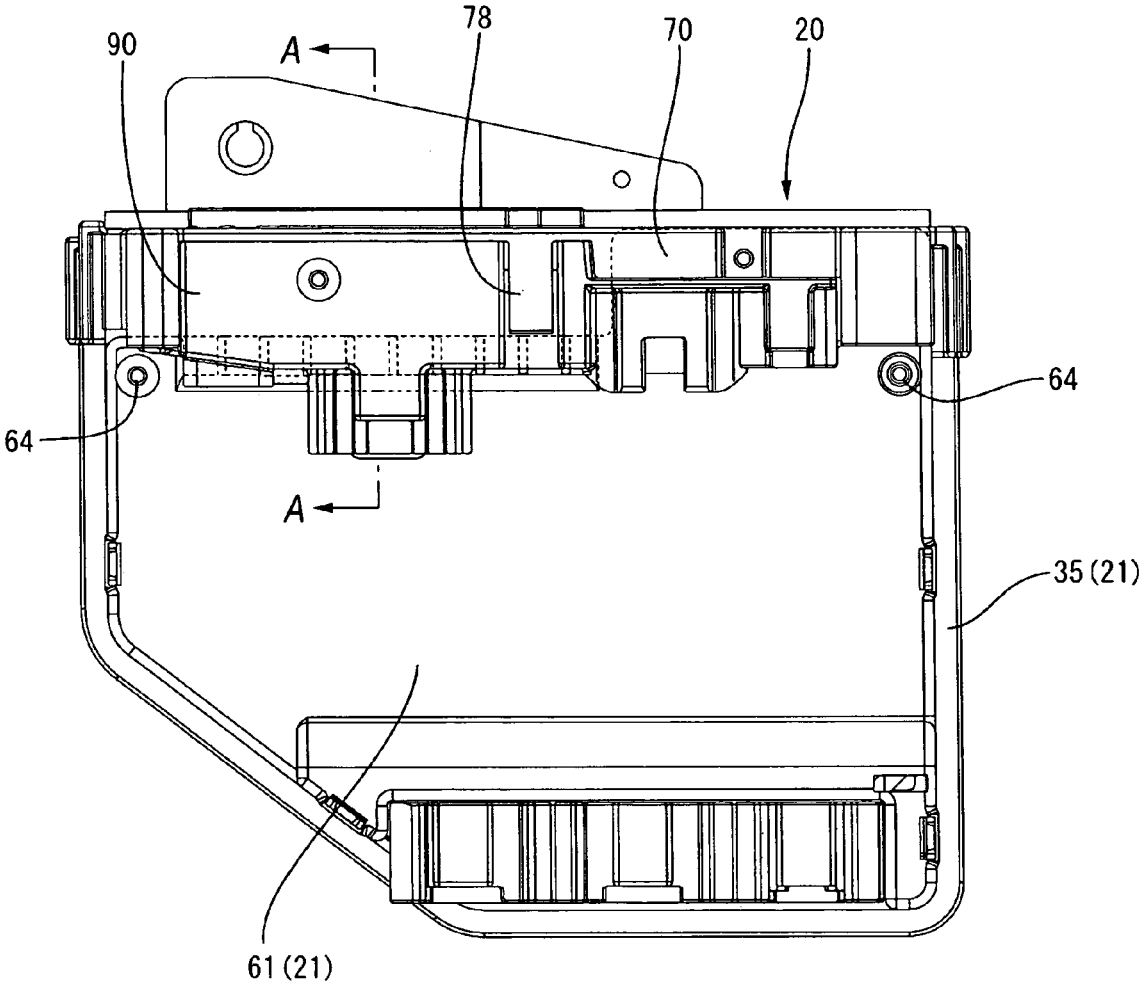
FIG. 1 is a front elevation view of the electrical connection box according to one embodiment of the present invention.

Reference numeral 20 in FIG. 1 denotes an electrical connection box used for automobiles, which is disposed being interposed between a power source such as a battery and electrical loads for distributing/supplying the power supplied from the power source to each of the electrical parts and controlling the switching of the power supply etc. The electrical connection box 20 includes mainly a casing 21 (circuit casing) for accommodating a circuit assembly unit 31, a fuse box 70 and an upper connector 90. The electrical connection box 20 is disposed, for example, in a vertical direction (the direction shown in FIG. 1) within an engine room.

The circuit assembly unit 31 includes a circuit board 33, an electronic part 32 mounted on a circuit pattern (not shown) formed on the surface of the circuit board 33 and bus bars 41 for a board made of a metal plate, which is disposed along the rear surface of the circuit board 33 and connected to the power source (not shown). The circuit board 33 and the bus bars 41 are integrated by means of adhesive (not shown) having an insulating characteristic. Here, the adhesive includes adhesive agent, adhesive sheet and the like.

The casing 21 comprises a frame 35 formed of plastic, a heat sink 39, which is formed of a metal (for example, aluminum alloy) in substantially same shape as the outer shape of the frame 35, and a cover 61. The frame 35 has a shape along the outer shape of the circuit board 33 continuing throughout the periphery thereof so as to enclose the circuit board 33. Also, in the upper portion (upper portion shown in FIG. 1) of the frame 35, a fuse box 70, which will be described in detail later, is mounted.

Figure 4:
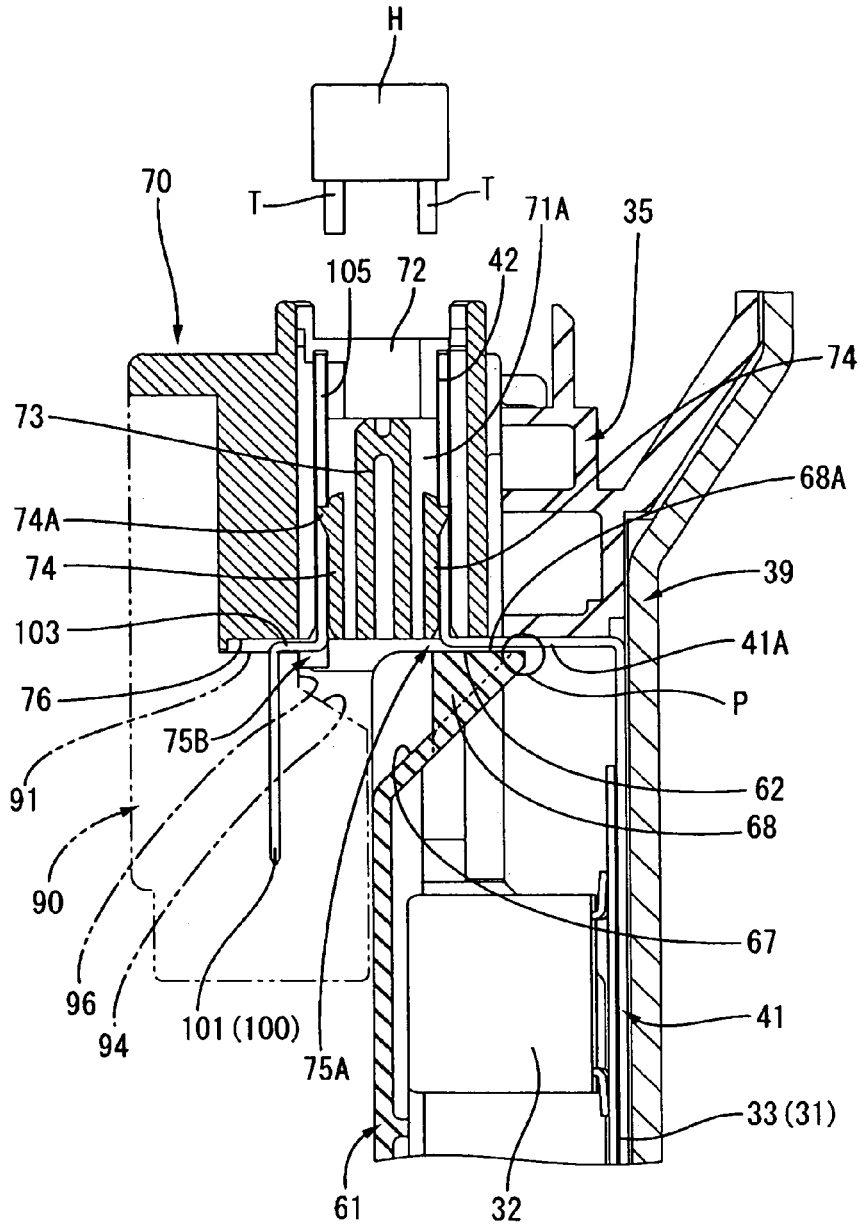
FIG. 4 is a sectional view taken along the line A-A in FIG. 1.
Figure 5:
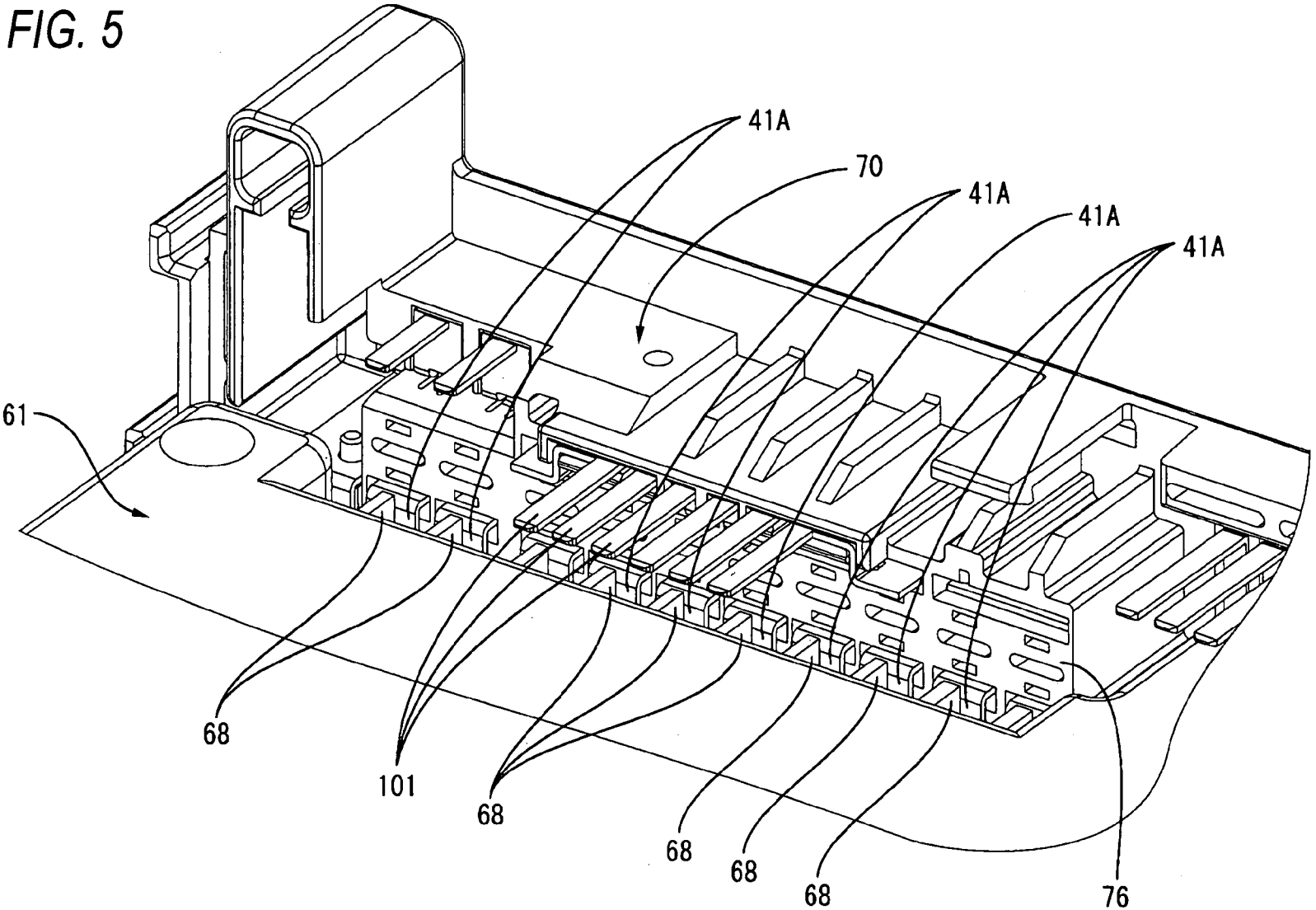
FIG. 5 is a perspective view showing a state where the support plate supports the bus bars for a board from the bottom.
Figure 6A:
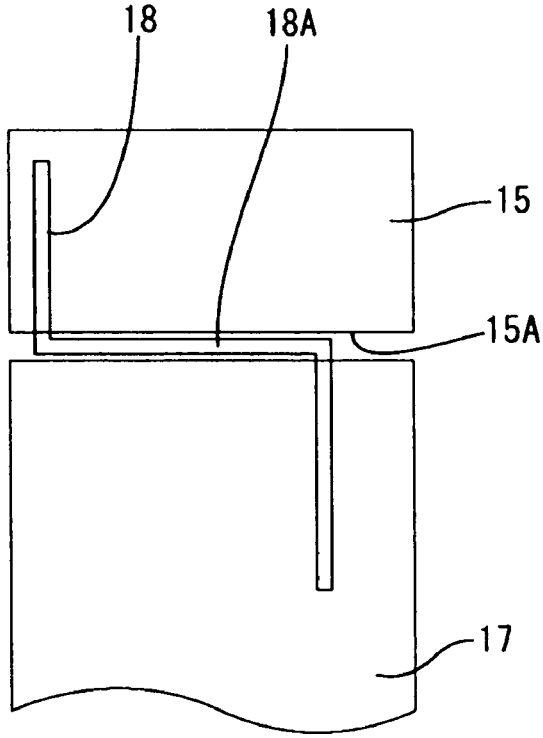
FIG. 6A (Prior Art)
FIGS. 6A and 6B are side views of an example in a related art.
Figure 6B:
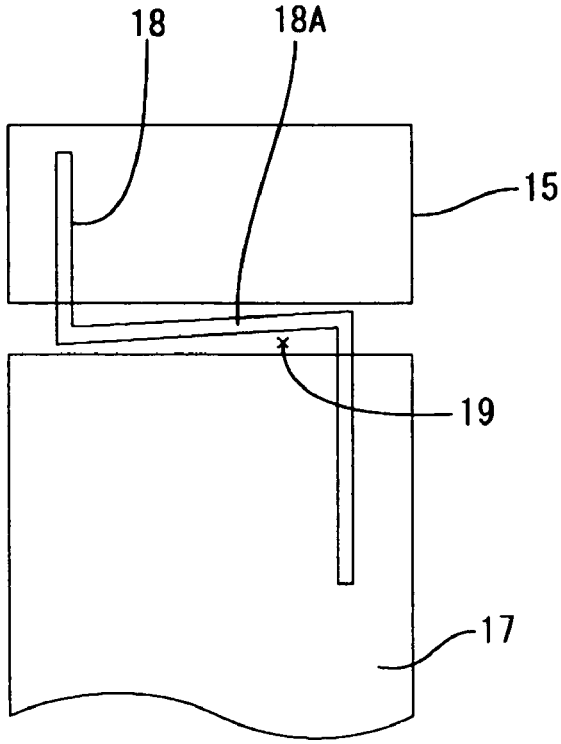
FIG. 6B (Prior Art)

Same as the heat sink 39, the cover 61 has substantially same shape as the outer shape of the frame 35. As shown in FIG. 4, the cover 61 and the heat sink 39 are arranged so as to position opposite each other at the right and left sides of the frame 35, and arranged so as, in a state accommodating the circuit assembly unit 31 within the frame 35, to close the opening of the frame 35. As shown in FIG. 1, at the right and left edges in the upper portion of the cover 61, counters 64 are formed so that the cover 61 is fixed to the frame 35 along with the fuse box 70 with, for example, screws.

The fuse box 70 formed of plastic has a box-like shape having an opening upward. As shown in FIG. 4, the inside of the fuse box 70 is segmented into a plurality of fuse chambers 72 by a partition wall 71A. In the bottom wall of the respective fuse chambers 72, a pair of terminal insertion holes 75A and 75B communicating with the fuse chambers 72 is formed in the right-left direction in FIG. 4. The bus bars 41 for a board are inserted through the right-side terminal insertion hole 75A. And bus bars 100 for a connector are inserted through the left-side terminal insertion hole 75B.

The bus bars 41 for a board will be described first below. The bus bars 41 are bent in a crank-like shape (a portion bent in the horizontal direction is defined as bent portion 41A), and the upper end portion thereof is bent upward in FIG. 4. The portion bent upward is a fuse terminal connecting section 42, and is inserted through the terminal insertion hole 75A. The bent portion 41A is disposed between the opposing faces of the fuse box 70 and the cover 61 (lower face 76 of the fuse box 70, upper surface 62 of the cover 61) along the both faces.

Figure 3:
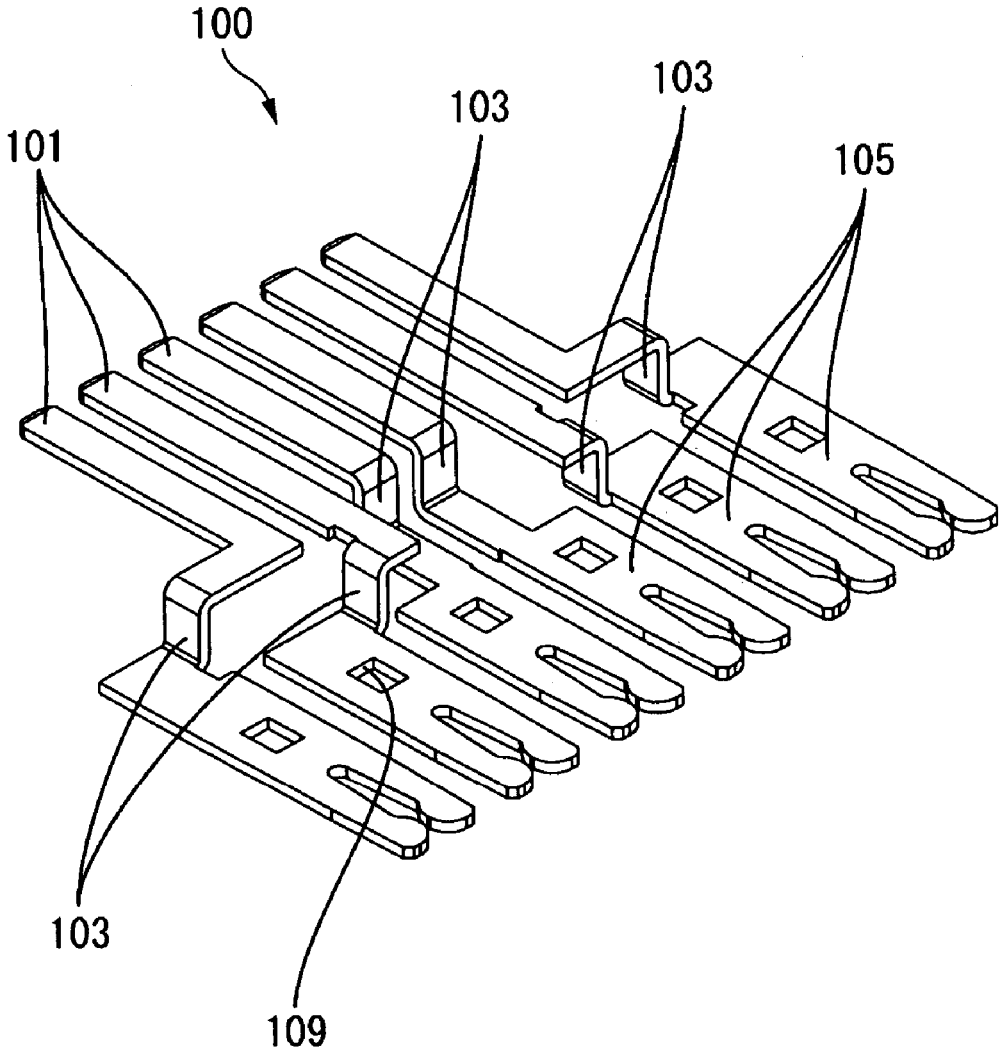
FIG. 3 is a perspective view of the bus bars for a connector.

On the other hand, as shown in FIG. 3, the bus bars 100 for a connector are formed in the following manner. That is, coupling sections 103 connect tabs 101 and fuse terminal connecting sections 105 therebetween, and the fuse terminal connecting sections 105 are arranged so as to insert through the terminal insertion hole 75B.

As shown in FIG. 4, between the terminal insertion holes 75A and 75B, a bridge wall 73 and hooking pieces 74 are formed at the both sides thereof. The hooking pieces 74 extend upward, and at the front-end portion thereof, a locking hook 74A is formed respectively. The locking hook 74A is arranged so as, when each of the fuse terminal connecting sections 42 and 105 is inserted up to a specified position shown in FIG. 4, engage with a locking hole 109 formed in each of the fuse terminal connecting sections 42 and 105 to prevent the fuse terminal connecting section 42 from being pulled out.

The fuse box 70 is arranged so that a fuse H is inserted into each of the fuse chambers 72 from the upper surface thereof. The fuse H is provided with a pair of fuse terminals T, and is arranged so that, in an inserted state, each of the fuse terminals T is connected to fuse terminal connecting sections 42 and 105 of the bus bars 41 for aboard and the bus bars 100 for a connector, respectively.

Also, from the central portion in the width direction of the fuse box 70, as shown in FIG. 1, a locking arm 78 is formed downward. The locking arm 78 is arranged so as to engage with lock receiving section formed in the upper connector 90, which functions to hold the upper connector 90 in a locked state.

The upper connector 90 is made of plastic, having a rectangular cylindrical shape long sideways, and is formed with a hood section so as to be engaged with a housing of other part from the front. As shown in FIG. 4, the upper connector 90 is disposed in a portion under the fuse box 70 in a state where the hood is oriented downward (in a state where the opening is oriented downward) so as to face the cover 61. In the upper face 91 of the upper connector 90 (the face opposite the lower face 76 of the fuse box 70), a receiving hole (not shown) communicating with each hood, passes through vertically. It is arranged so that the tab 101 of the bus bars 100 for a connector is inserted into the receiving hole.

In the fuse box 70, since the upper face thereof is open, water drops may occasionally invade into the fuse box 70. The invaded water drops accumulate in the bottom of the fuse chamber 72. And then, the water flows along the bus bars 41 for a board or the bus bars 100 for a connector.

On the other hand, in the embodiment of the present invention, the bus bars 41 for a board and the bus bars 100 for a connector are pulled out though the lower face 76 of the fuse box 70. And then, the bus bars 41 and 100 are bent into a crank-like shape and laid in a wiring path along the lower face 76 thereof, respectively. Below the bent portion (bent portion 41A, coupling section 103), the cover 61 arranged with the upper connector 90 are positioned (refer to FIG. 4). Therefore, there is a possibility that while flowing along the bus bars 41 for a board or the bus bars 100 for a connector, the water drops may be caught on the upper faces 62 and 91 of the cover 61 and the upper connector 90; and there, short-circuits may occur between the adjacent bus bars 41 for a board or bus bars 100 for a connector.

Therefore, in the embodiment of the present invention, between the bent portion 41A of the bus bars 41 for a board and the upper face 62 of the cover 61, and between the coupling section 103 of the bus bars 100 for a connector and the upper face 91 of the upper connector 90, a draining space is formed respectively.

Referring to FIG. 4, a further detailed description will be given below. In the upper face 91 of the upper connector 90, a step 96 is formed. From the lower end of the step 96, a connector-side draining slope 94, which is inclined downward toward the cover 61, is formed. The end of the connector-side draining slope 94 reaches to the side face (facing the cover 61) 90A of the upper connector 90. Owing to this, a draining space is at least partially formed between the coupling section 103 and the connector-side draining slope 94. A part of the draining space is formed over the full width in the direction of the bus bars 100 for connector are aligned.

On the other hand, in the upper face 62 of the cover 61, a cover-side draining slope 67 is formed. The cover-side draining slope 67 is formed from a P-portion shown in FIG. 4 (portion from which bent portion 41A of the bus bars 41 for a board is pulled out to the outside from the inside of the frame 35) as the start point. Being inclined downward toward the upper connector 90, the end of the slope reaches up to the wall surface (facing the upper connector) 61A of the cover 61. Owing to this, a draining space is formed between the bent portion 41A and the cover-side draining slope 67. A part of the draining space is formed over the full width in the direction where the bus bars 41 for a board are aligned.

These draining slopes 67 and 94 are formed being faced to each other. However the inclination angle of the cover-side draining slope 67 is larger than that of the other (a slope of approximately 45°), and the lower end thereof is positioned lower than that of the lower end of the connector-side draining slope 94.

Figure 2:
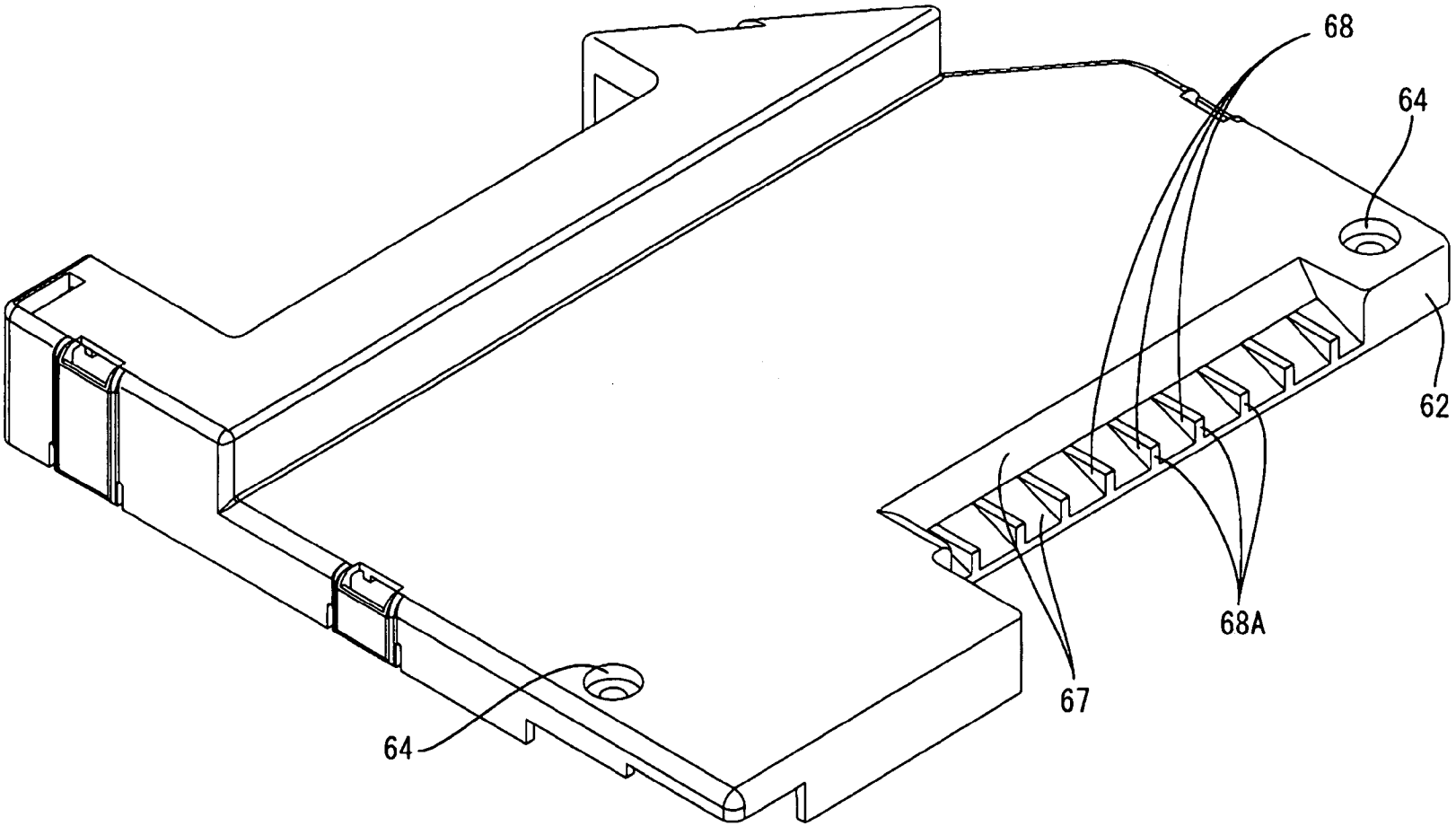
FIG. 2 is a perspective view of the cover.

Also, as shown in FIG. 2, in the draining slope 67 of the cover 61, a plurality of support plates 68 are formed in parallel along the direction where the bus bars 41 for a board are aligned. In each of the support plates 68, the plate face thereof has a triangle shape along the wiring direction of the bent portion 41A of the bus bars 41 for a board, and is disposed at a position opposed to the bent portion 41A (refer to FIG. 4). And in the support plate 68, the pieces at the side opposite the bent portion 41A serve as a back face 68A with respect to the bent portion 41A. The back faces 68A are formed in a plane shape along the bent portion 41A of the bus bars 41 for a board, and come into contact with the substantially overall length of the portion exposed from the frame 35 in the bent portion 41A (portion positioned at the left-side viewed from the P-portion in FIG. 4) to support the bent portion 41A from the bottom. In the bus bars 41 for a board, the wiring direction of the bent portion 41A is the right-left direction in FIG. 4.

By arranging as described above, the bus bars 41 for a board can be prevented from being deformed. That is, when the fuse H is replaced, on the bent portion 41A of the bus bars 41 for a board, a downward press force is applied via the fuse H. However, in the structure as described above, the support plate 68 can reliably support the bent portion 41A. Accordingly, even when a downward press force is applied to the bent portion 41A, the bent portion 41A is prevented from being deformed.

Effects of the embodiment will be described below.

The fuse H is replaced in a state that the hood of vehicle is opened. For example, when the replacing work is carried out in rain, water drops may occasionally invade into the fuse chamber 72 of the fuse box 70. The water drops invaded into the fuse chamber 72 flow along the insert holes 75A and 75B formed in the fuse chamber 72 toward the lower face 76 of the fuse box 70. After that, the water drops at the bus bars 41 for a board gradually flow along the bent portion 41A of the bus bars 41 toward the cover 61. The water drops at the bus bars 100 for a connector flow along the coupling section 103 of the bus bars 100 toward the upper connector 90. The water drops reach to the start-end of the cover-side draining slope 67 or the connector-side draining slope 94. After that the water drops flow downward along the draining slopes 67 and 94. Accordingly, the water drops do not remain on the cover 61 and the upper faces 62 and 91 of the upper connector 90. Thus, short-circuits between adjacent bus bars at those portions can be prevented.

When the fuse H is mounted, to the bus bars 41 for a board and the bus bars 100 for a connector, a press force is applied downward via the fuse H. Particularly, in the bus bars 41 for a board, as shown in FIG. 4, since the length of the bent portion 41A is longer than the overall length of the coupling section 103, a strong force is applied to the P-portion in FIG. 4. However, since the support plate 68 supports the bent portion 41A of the bus bars 41 for a board over its length, the bent portion 41A can satisfactorily withstand the press force. Further, each of the support plates 68 supports each of the bus bars 41 for a board independently respectively, the reliability to the support of the bus bars is increased.

<Other Embodiments>

The present invention is not limited to the above-described embodiment referring to the drawings. For example, the following embodiments should be included in the technical scope of the present invention. Further, in addition to the following embodiments, it is possible to carry out the present invention in various modifications within the scope of the present invention.

(1) In the above embodiment, a plurality of support plates 68 are disposed in parallel to the direction of the aligned bus bars 41 for a board to support each of the bus bars 41 for a board independently. However, the support plates 68 may be arranged so as to support the bus bars 41 as a unit.

(2) In the above embodiment, the support plates 68 are formed on the cover-side draining slope 67 only. However, the support plates 68 may be formed on the connector-side draining slope 94 to support the bus bars 100 for a connector.

What is claimed is:

1. An electrical connection box, comprising:

a fuse box having a bottom wall, the fuse box detachably and attachably accommodating a fuse element;

a circuit casing being disposed below the fuse box, the circuit casing having a supporting section on an upper surface thereof the circuit casing accommodating a circuit assembly unit; and a plurality of bus bars electrically connecting between the fuse box and the circuit assembly unit, each bus bar being pulled out from the bottom face of the fuse box and drawn into the circuit casing through a wiring path of each bus bar along a lower surface of the bottom wall of the fuse box, wherein a draining space is formed between the fuse box and the circuit casing, an external face of the draining space comprising at least one of an external face of the circuit casing or an external face of the connector, and the sides of the draining space are sloped away from the fuse portion, and wherein the supporting section of the circuit casing supports the bus bars from a lower side of the bus bars to at least partially come into contact with the bus bar along the bottom wall of the fuse box.

2. An electrical box, comprising:

a fuse box having a bottom wall, the fuse box detachably and attachably accommodating a fuse element;

a circuit casing being disposed below the fuse box, the circuit casing having a supporting section on an upper surface thereof; the circuit casing accommodating a circuit assembly unit; and a plurality of bus bars electrically connecting between the fuse box and the circuit assembly unit, each bus bar being pulled out from the bottom face of the fuse box and drawn into the circuit casing through a wiring path of each bus bar along a lower surface of the bottom wall of the fuse box, wherein a draining space is formed between the fuse box and the circuit casing, wherein the supporting section of the circuit casing supports the bus bars from a lower side of the bus bars to at least partially come into contact with the bus bar along the bottom wall of the fuse box, wherein the supporting section of the circuit casing comprises a plurality of support plates along a direction of the bus bars aligned with each other, and wherein each support plate is opposing each bus bar to support the bus bars independently.

* * * * *